US011414736B2

(12) United States Patent
Kimijima et al.

(10) Patent No.: US 11,414,736 B2
(45) Date of Patent: Aug. 16, 2022

(54) PRODUCTION METHOD OF HOT-DIP GALVANIZED STEEL SHEET

(71) Applicant: Kobe Steel, Ltd., Kobe (JP)

(72) Inventors: Kazuya Kimijima, Kakogawa (JP); Seiji Morishige, Kakogawa (JP); Shinobu Nakayama, Kakogawa (JP); Ryo Sasaki, Kobe (JP); Mikako Takeda, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 227 days.

(21) Appl. No.: 16/652,196

(22) PCT Filed: Sep. 13, 2018

(86) PCT No.: PCT/JP2018/033956
§ 371 (c)(1),
(2) Date: Mar. 30, 2020

(87) PCT Pub. No.: WO2019/082542
PCT Pub. Date: May 2, 2019

(65) Prior Publication Data

US 2020/0248294 A1 Aug. 6, 2020

(30) Foreign Application Priority Data

Oct. 26, 2017 (JP) ..... JP2017-207575

(51) Int. Cl.
*C23C 2/02* (2006.01)
*C21D 9/46* (2006.01)
(Continued)

(52) U.S. Cl.
CPC ..... *C23C 2/02* (2013.01); *C21D 8/0278* (2013.01); *C21D 9/46* (2013.01); *C22C 38/02* (2013.01);
(Continued)

(58) Field of Classification Search
CPC ..... C21D 1/52; C21D 8/0278; C21D 9/46; C21D 9/56; C22C 38/00; C22C 38/02;
(Continued)

(56) References Cited

U.S. PATENT DOCUMENTS

2016/0304982 A1 10/2016 Makimizu et al.
2017/0253943 A1 9/2017 Makimizu et al.

FOREIGN PATENT DOCUMENTS

EP 3 428 303 A1 1/2019
JP 2012-36437 A 2/2012
WO WO-2016038801 A1 * 3/2016 ..... C22C 38/02

OTHER PUBLICATIONS

Written Opinion of the International Searching Authority dated Nov. 27, 2018 in PCT/JP2018/033956 (with English translation), 11 pages.

* cited by examiner

*Primary Examiner* — Jenny R Wu
(74) *Attorney, Agent, or Firm* — Oblon, McClelland, Maier & Neustadt, L.L.P.

(57) ABSTRACT

The present invention is a production method of a hot-dip galvanized steel sheet including annealing a belt-shaped steel sheet having a Si content of greater than or equal to 0.2% by mass, wherein the annealing is continuously carried out using an annealing furnace having an oxidation heating zone and a reduction heating zone in this order, while the steel sheet is fed using rollers. The annealing includes oxidizing a surface of the steel sheet in the oxidation heating zone at a temperature at which roll pickup does not occur and reducing an iron oxide layer, formed by the oxidizing, in the reduction heating zone before the iron oxide layer reaches an initial roller in the reduction heating zone.

8 Claims, 3 Drawing Sheets

(51) Int. Cl.

| | |
|---|---|
| ***C22C 38/02*** | (2006.01) |
| ***C23C 2/06*** | (2006.01) |
| ***C23C 2/40*** | (2006.01) |
| ***C21D 8/02*** | (2006.01) |
| *C21D 9/56* | (2006.01) |

(52) U.S. Cl.
CPC ..... *C23C 2/06* (2013.01); *C23C 2/40* (2013.01); *C21D 9/56* (2013.01)

(58) Field of Classification Search
CPC .. C22C 38/06; C23C 2/02; C23C 2/06; C23C 2/28; C23C 2/40
See application file for complete search history.

PRODUCTION METHOD OF HOT-DIP GALVANIZED STEEL SHEET

TECHNICAL FIELD

The present invention elates to a production method of a hot-dip galvanized steel sheet.

BACKGROUND ART

Recently, there has been a demand for a reduction in weight and higher strength in car bodies to improve both fuel efficiency and collision safety of cars. Therefore, high-strength steel sheets, which are highly strengthened and thin-walled, have been used as materials of car bodies. As such high-strength steel sheets, surface-treated steel sheets imparted with a rust-preventive property, particularly a hot-dip galvanized steel sheet and a hot-dip galvannealed steel sheet, which are superior in rust prevention, can be exemplified. An addition of Si, Mn, and/or the like is effective to further increase the strength of the steel sheets.

In general, a hot-dip galvanized steel sheet is produced by using a belt-shaped steel sheet obtained by hot-rolling and cold-rolling a slab as a base steel sheet; recrystallizing and annealing the base steel sheet in a reducing atmosphere in an annealing furnace; and then subjecting the base steel sheet to a hot-dip galvanization process. However, oxidation of Si, Mn, and/or the like contained in the steel sheet progresses even in a reducing atmosphere containing a hydrogen gas, which is reductive and does not cause oxidation of iron, and an oxide of Si, Mn, and/or the like is formed on a surface of the steel sheet. This oxide deteriorates the wettability between molten zinc and the steel sheet in the coating process; thus, in a case of using a base steel sheet to which Si, Mn, and/or the like has been added, coating adhesiveness is likely to decrease.

As a production method of a base steel sheet in which the coating adhesiveness of the base steel sheet to which Si, Mn, and/or the like is added is improved, a production method by an oxidation-reduction process using an annealing furnace having an oxidation heating zone and a reduction heating zone has been in practical use. In this production method, an oxide film of iron is formed on a surface of a steel sheet, the oxide film is reduced in a reducing atmosphere containing hydrogen, and then a coating process is performed. By forming the oxide film of the iron on the surface of the steel sheet in advance in this manner, Si and/or Mn is subsequently oxidized inside the steel sheet in the reducing atmosphere; thus, oxidation of Si and/or Mn on the surface of the steel sheet can be prevented. Accordingly, the coating adhesiveness after annealing is easily ensured.

However, the production method by the oxidation-reduction process is liable to cause roll pickup, as generally referred to, wherein iron oxide formed on the surface of the steel plate in the oxidation heating zone adheres to a roller which feeds the steel plate, causing a pressing mark on the steel plate. Such roll pickup is particularly likely to occur in a vertical furnace, in which the steel sheet is in contact with the roller for a longer time period than in a horizontal furnace.

As a production method of a base steel sheet in which roll pickup in the vertical furnace is prevented, for example, a production method has been proposed in which a heating furnace provided with three or more heating zones having a direct-fired burner group is used, and in each heating zone, burning conditions are optimized in terms of an air ratio of the direct-fired burners and a heating temperature of the steel sheet to properly control an amount of internal oxidation (see Japanese Unexamined Patent Application, Publication No. 2012-36437). In the production method as conventionally performed, the direct-tired burner is used for reduction. Since oxygen remaining after burning with the direct-fired burners and water vapor generated by burning have oxidizing properties, an amount of reduction is likely to be insufficient and an effect of inhibiting roll pickup is likely to be unsatisfactory. Moreover, since heating with the direct-fired burners is also performed in the reduction treatment, a thickness of the oxide film of the iron is difficult to measure and to control.

Another production method has been proposed in which oxidation and reduction are performed in an atmosphere containing water vapor (see Japanese Unexamined Patent Application, Publication No. 2016-53211). In the production method as conventionally performed, coating adhesiveness is ensured by performing an alloying treatment at a temperature in accordance with a water vapor concentration in a reduction annealing. When the production method as conventionally performed is applied to a vertical furnace, however, a temperature of the steel sheet decreases due to the water vapor, which may lead to an insufficient amount of reduction or cause deformation (buckling) in a width direction of the steel sheet.

PRIOR ART DOCUMENTS

Patent Documents

Patent Document 1: Japanese Unexamined Patent Application, Publication No. 2012-36437

Patent Document 2: Japanese Unexamined. Patent Application Publication No. 2016-53211

SUMMARY OF THE INVENTION

Problems to be Solved by the Invention

The present invention has been made in view of the foregoing circumstances, and an object of the present invention is to provide a production method of a. hot-dip galvanized steel sheet which enables prevention of roll pickup while maintaining superior coating adhesiveness, even in a vertical furnace.

Means for Solving the Problems

The invention made for solving the aforementioned problems is a production method of a hot-dip galvanized steel sheet including annealing a belt-shaped steel sheet having a Si content of greater than or equal to 0.2% by mass, wherein the annealing is continuously carried out using an annealing furnace having an oxidation heating zone and a reduction heating zone in this order, while the steel sheet is fed using rollers. The annealing includes oxidizing a surface of the steel sheet in the oxidation heating zone at a temperature at which roll pickup does not occur; and reducing an iron oxide layer, formed by the oxidizing, in the reduction heating zone before the iron oxide layer reaches an initial roller in the reduction heating zone.

The production method of a hot-dip galvanized steel sheet employs an oxidation-reducing method, thus providing superior coating adhesiveness. In the production method of a hot-dip galvanized steel sheet, roll pickup is prevented by forming the oxide layer in the oxidizing at a temperature at which roll pickup does not occur, i.e. a temperature at which oxides of iron are less likely to sinter with each other. Furthermore, in the production method of a hot-dip galvanized steel sheet, the iron oxide layer is reduced in the reducing before reaching the initial roller; therefore, the iron oxide, which causes roll pickup, is removed from the steel sheet before it reaches the initial roller in the reduction heating zone. Hence, the use of the production method of a hot-dip galvanized steel sheet enables prevention of roll pickup while maintaining superior coating adhesiveness, regardless of whether a vertical furnace or a horizontal furnace is used.

In the oxidizing, an oxidation temperature of the steel sheet is preferably less than or equal to 740° C. The iron oxide generated in the oxidizing mainly comprises $Fe_3O_4$. By setting the oxidation temperature in the oxidizing to be less than or equal to the upper limit, sintering of the $Fe_3O_4$ can be inhibited, enabling more certain prevention of roll pickup in the oxidation heating zone.

In the reducing, a reduction temperature of the iron oxide layer at the initial roller in the reduction heating zone is preferably greater than or equal to 750° C. Furthermore, a reduction time period during which the reduction temperature of the iron oxide layer is greater than or equal to 700° C. in a segment from an inlet of the reduction heating zone to the initial roller in the reduction heating zone is preferably greater than or equal to 20 sec. By setting the reduction temperature of the iron oxide layer at the initial roller in the reduction heating zone to be greater than or equal to the lower limit and setting the reduction time period during which the reduction temperature is greater than or equal to 700° C. to be greater than or equal to the lower limit, the iron oxide layer can be more certainly reduced before reaching the initial roller in the reduction heating zone. Accordingly, roll pickup in the reduction heating zone can be more certainly prevented.

A direct-fired burner is preferably used as a heating device in the oxidation heating zone. Using a direct-fired burner as the heating device in the oxidation heating zone in this way allows a thickness of the iron oxide layer to be easily controlled by controlling an air ratio. Thus, roll pickup can be easily prevented while coating adhesiveness is maintained.

It is to be noted that the "hot-dip galvanized steel sheet" as referred to herein includes a hot-dip galvannealed steel sheet.

Effects of the Invention

As described above, use of the production method of a hot-dip galvanized steel sheet of the present invention enables prevention of roll pickup while superior coating adhesiveness is maintained, even in a vertical furnace.

DESCRIPTION OF EMBODIMENTS

Embodiments of the production method of a hot-dip galvanized steel sheet of the present invention will be described below with appropriate reference to the drawings.

Figure 1:
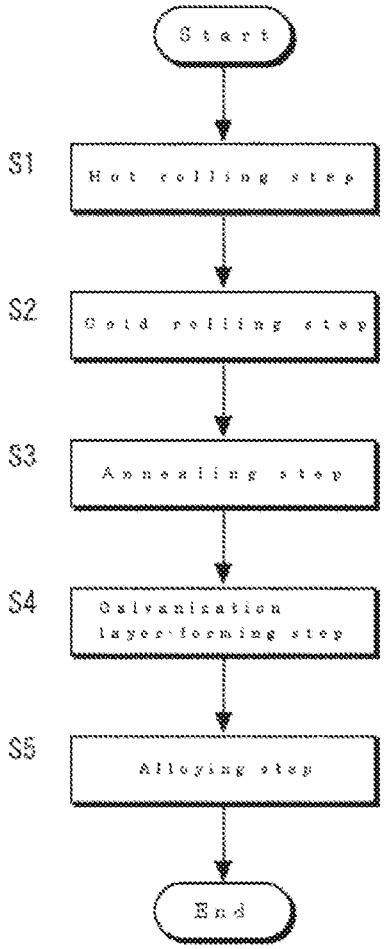
FIG. 1 is a flowchart illustrating a procedure of a production method of a hot-dip galvanized steel sheet according to an embodiment of the present invention.

The production method of a hot-dip galvanized steel sheet includes, for example, as illustrated in FIG. 1, a hot rolling step S1, a cold rolling step S2, an annealing step S3, a galvanized layer-forming step S4, and an alloying step S5.

Hot Rolling Step

In the hot rolling step S1, a slab is hot rolled to obtain a steel sheet which is to serve as a base material.

As the hot rolling process, a known process can be employed without particular limitation; for example, steel is melted by a conventional melting procedure, the molten steel is cooled to be a slab, and then, using the slab, a belt-shaped steel sheet which will serve as a base material with an average thickness of greater than or equal to 1 mm and less than or equal to 5 mm, for example, is obtained.

Base Steel Sheet

The base steel sheet contains Si. Si is an element that can ensure ductility and processability of steel while maintaining strength thereof. The lower limit of a content of Si is 0.2% by mass, preferably 0.5% by mass, and more preferably 1.0% by mass. Meanwhile, the upper limit of the content of Si is preferably 3.0% by mass, and more preferably 2.5% by mass. When the content of Si is below the lower limit, another alloy element may be needed to obtain both strength and processability, which may increase production cost. Conversely, when the content of Si exceeds the upper limit, formation of an iron oxide layer may be inhibited in an oxidizing step S31 of the annealing step S3, as described later, which may cause a Si oxide to deteriorate the coating adhesiveness.

Moreover, besides Si, the base steel sheet may contain Mn, C, Cr, Ti, Al, P, S, and/or the like. Note that the remainder of the base steel sheet comprises iron and inevitable impurities.

In particular, Mn is a useful element for ensuring the strength and toughness of steel. In a case of adding Mn to the base steel sheet, the lower limit of a content of Mn is preferably 1.0% by mass, and more preferably 1.5% by mass. Meanwhile, the upper limit of the content of Mn is preferably 3.5% by mass, and more preferably 3.0% by mass. By setting the content of Mn to be greater than or equal to the lower limit, the strength and toughness of steel can be increased. Furthermore, by setting the content of Mn to be less than or equal to the upper limit, a decrease in the ductility of steel can be inhibited.

Cold Rolling Step

In the cold rolling step S2, the steel sheet after the hot rolling step S1 is cold rolled.

As a cold rolling process, a known process can be employed without particular limitation. For example, the steel sheet after the hot rolling step S1 is subjected to pickling to remove scales from a surface and is then cold-rolled by a conventional process.

In the pickling, in light of promoting oxidation of the steel sheet in the annealing step S3 described later, a grain boundary oxide layer is preferably left on the surface of the steel sheet. The "grain boundary oxide layer" as referred to herein means a layer of Si oxidized along a crystal grain boundary in a ferrite surface layer of the steel sheet containing Si. An average thickness of the grain boundary oxide layer to be left is preferably greater than or equal to 5 μm and less than or equal to 20 μm. It is to be noted that the average thickness of the grain boundary oxide layer can be adjusted by pickling conditions.

Annealing Step

Figure 2:
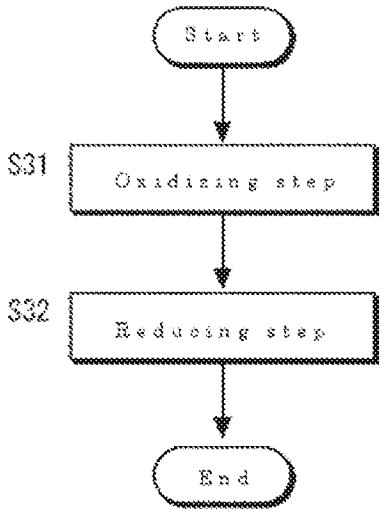
FIG. 2 is a schematic flowchart illustrating the annealing in FIG. 1.

In the annealing step S3, the steel sheet is continuously annealed while being fed by rollers. In the production method of a hot-dip galvanized steel sheet, the annealing step S3 mainly includes, as illustrated in FIG. 2, the oxidizing step S31 and a reducing step S32.

Figure 3:
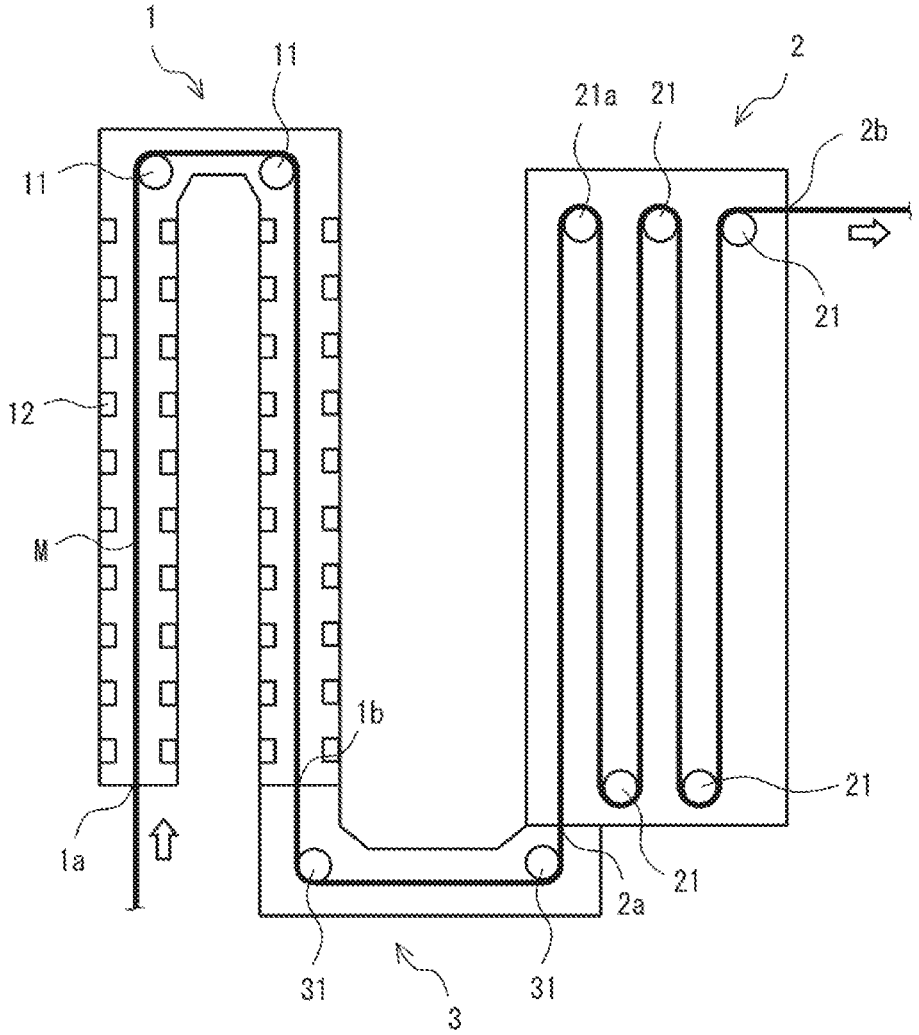
FIG. 3 is a schematic cross-sectional view illustrating an annealing furnace used in the annealing in FIG. 2.

Treatment in the annealing step S3 is performed using an annealing furnace illustrated in FIG. 3. The annealing furnace in FIG. 3 is a vertical annealing furnace having an oxidation heating zone 1 and a reduction heating zone 2, in this order, along a conveying direction of a steel sheet M. In addition, the annealing furnace has a conveying path 3 which connects the oxidation heating zone 1 to the reduction heating zone 2.

The oxidation heating zone 1, having rollers 11, feeds the belt-shaped steel sheet M, which is loaded from an inlet of the oxidation heating zone 1*a*, while changing the traveling direction by the rollers 11, and unloads the steel sheet M from an outlet of the oxidation heating zone 1*b*. An inlet of the conveying path 3 is connected to the outlet of the oxidation heating zone 1*b*, and an exit thereof is connected to an inlet of the reduction heating zone 2*a*. The conveying path 3, having rollers 31, feeds the steel sheet M unloaded from the outlet of the oxidation heating zone 1*b* while changing the traveling direction by the rollers 31, and loads the steel sheet M into the inlet of the reduction heating zone 2*a*. The reduction heating zone 2, having rollers 21, feeds the steel sheet M loaded from the inlet of the reduction heating zone 2*a* while changing the traveling direction by the rollers 21, and unloads the steel sheet M from an outlet of the reduction heating zone 2*b*. In the annealing furnace, the steel sheet M can be continuously annealed while being fed by the rollers in this manner. Furthermore, such feeding by the rollers can realize a reduction in space of the annealing furnace.

The oxidation heating zone 1 has direct-fired burners 12. Further, the reduction heating zone 2 is configured to be airtight, and a reducing atmosphere can be created by introducing a high-temperature gas mixture mainly containing hydrogen and nitrogen into the reduction heating zone 2.

Oxidizing Step

In the oxidizing step S31, the surface of the steel sheet M is oxidized in the oxidation heating zone 1. By the oxidizing, the iron oxide layer is formed on the surface of the steel sheet M.

As a heating device of the oxidation heating zone 1, the direct-tired burners 12 can be used. By using the direct-fired burners 12 as a heating device in the oxidation heating zone 1 in this way, the oxygen concentration can be adjusted by controlling an air ratio, and a thickness of the iron oxide layer can be easily controlled. Furthermore, because a rate of temperature rise of the steel sheet M can be increased; the furnace length of the oxidation heating zone 1 can be reduced, achieving a reduction in space of the heating furnace and/or raising a feeding speed of the steel sheet M to increase production efficiency.

The oxidation in the oxidizing step S31 is performed at a temperature at which roll pickup does not occur. The present inventors consider that: first, oxides, being powdery in form and which are generated on the surface of the steel sheet M, initially attach to surfaces of the rollers 11; then the oxides (attached substances) thus attached grow by coining in contact and sintering with each other; and then the attached substances, having grown, cause a pressing mark on the steel sheet M. Furthermore, a temperature at which the oxides sinter is higher than a temperature at which the oxides are generated. In other words, the present inventors have found that, as a heating temperature of the steel sheet M in the oxidizing step S31, there exist temperatures at which oxidation of the steel sheet M progresses but sintering does not occur, that is, temperatures at which roll pickup does not occur. Moreover, the temperatures at which sintering does not occur are independent from a type or condition of the rollers; therefore, the present inventors have found that the occurrence of roll pickup in the oxidation heating zone 1 can be inhibited by controlling only an oxidation temperature T0 of the steel sheet M, thus completing the present invention.

In general, $Fe_3O_4$ accounts for greater than or equal to 60% by volume of the oxides generated on the surface of the steel sheet M in the oxidizing step S31. Hence, the oxidation is preferably performed at a temperature at which $Fe_3O_4$ is not sintered. Specifically, the upper limit of the oxidation temperature T0 of the steel sheet M is preferably 740° C., and more preferably 720° C. When the oxidation temperature T0 of the steel sheet M exceeds the upper limit, the oxides may sinter with each other, and roll pickup may occur. Meanwhile, the lower limit of the oxidation temperature T0 of the steel sheet M is determined depending on the temperature at which the surface of the steel sheet M can be oxidized; the lower limit of the oxidation temperature T0 of the steel sheet M is preferably 600° C., more preferably 650° C., and still more preferably 700° C. When the oxidation temperature T0 of the steel sheet M is below the lower limit: a decrease in speed of forming the iron oxide layer may lower the production efficiency; and a lowered temperature of the steel sheet M at a beginning of reduction in the subsequent reducing step S32 may result in insufficient reduction.

It is to be noted that, in general, the temperature of the steel sheet M peaks at the outlet of the oxidation heating zone 1*b* because of being gradually raised due to heating by the direct-fired burners 12. Therefore, setting the oxidation temperature T0 of the steel sheet M to be less than or equal to the upper limit is substantially equivalent to setting the temperature of the steel sheet M at the outlet of the oxidation heating zone 1*b* to be less than or equal to the upper limit. Accordingly, the oxidation temperature T0 can be controlled at the outlet of the oxidation heating zone 1*b*.

The lower limit of the air ratio (volume ratio of air to a combustion gas) of the direct-tired burners 12 is preferably 0.9, and more preferably 1.0. Meanwhile, the upper limit of the air ratio of the direct-fired burners 12 is preferably 1.3, and more preferably 1.2. When the air ratio of the direct-fired burners 12 is below the lower limit, oxidation of the surface of the steel sheet M may be insufficient due to lack of oxygen. Conversely, when the air ratio of the direct-fired burners 12 exceeds the upper limit, the oxidizing ability is saturated, which may lower thermal efficiency for oxidation.

The lower limit of the rate of temperature rise of the steel sheet M by the direct-fired burners 12 is preferably 30° C./sec, and more preferably 35° C./sec. Meanwhile, the upper limit of the rate of temperature rise is preferably 100° C./sec, and more preferably 50° C./sec. When the rate of temperature rise is below the lower limit, a time period needed for heating the steel sheet M to the desired oxidation temperature T0 may lower the production efficiency. Conversely, when the rate of temperature rise exceeds the upper limit, the controllability of the temperature of the steel sheet M may be lowered, or the steel sheet M may be deformed due to abrupt heating.

An oxidation time period in the oxidizing step S31 is appropriately determined in light of the oxidation temperature T0 and the production efficiency, and can be greater than or equal to 15 sec and less than or equal to 180 sec.

The lower limit of the average thickness of the iron oxide layer formed in the oxidizing step S31 is preferably 0.1 μm, and more preferably 0.3 μm. Meanwhile, the upper limit of the average thickness of the iron oxide layer is preferably 1.5

μm, and more preferably 1.3 μm. When the average thickness of the iron oxide layer is below the lower limit, an effect of improving the coating adhesiveness may be insufficient. Conversely, when the average thickness of the iron oxide layer exceeds the upper limit, the iron oxide layer becomes unduly thick and the reduction time period in the subsequent reducing step S32 is prolonged, which may lower the production efficiency.

It is to be noted that the steel sheet M oxidized in the oxidation heating zone 1 is fed into the reduction heating zone 2 via the conveying path 3 while maintaining a high temperature. To avoid undue oxidation in the conveying path 3, the conveying path 3 is preferably under a nitrogen atmosphere.

Reducing Step

In the reducing step S32, the iron oxide layer formed in the oxidizing step S31 is reduced in the reduction heating zone 2. In the reduction, the iron oxide layer is reduced to form a reduced iron layer on the surface of the steel sheet M. Meanwhile, oxygen supplied from the iron oxide layer by the reduction oxidizes elements such as Si in the steel sheet M. Consequently, the oxides of Si and the like remain inside the steel sheet M, and generation of the oxides of Si and the like on the surface of the steel sheet M is inhibited. Accordingly, deterioration of the coating adhesiveness due to elements such as Si can be inhibited. It is to be noted that the reducing step S32 continues even after the reduction of the iron oxide layer is completed; the annealing is performed such that oxidation of iron does not occur even if the steel sheet M is exposed to a high temperature of greater than or equal to 800° C.

The reduction in the reduction heating zone 2 is performed using a high-temperature gas mixture mainly containing hydrogen and nitrogen. Specifically, the reduction heating zone 2 is filled with the gas mixture to create a reducing atmosphere. The lower limit of the hydrogen concentration in a furnace atmosphere of the reduction heating zone 2 is preferably 3% by volume, and more preferably 5% by volume. Meanwhile, the upper limit of the hydrogen concentration is preferably 30% by volume, and more preferably 25% by volume. When the hydrogen concentration is below the lower limit, reduction of the iron oxide layer may be insufficient. Conversely, when the hydrogen concentration exceeds the upper limit, the rise in cost for necessary hydrogen gas increases relative to an increase in reducing ability, which may lead to insufficient cost-effectiveness.

Other than hydrogen, the remainder of the gas mixture includes nitrogen and inevitable impurities such as moisture. The upper limit of a dew point of the gas mixture is preferably 0° C., and more preferably −10° C. When the dew point of the gas mixture exceeds the upper limit, reduction of the iron oxide layer may be insufficient. Meanwhile, the lower limit of the dew point of the gas mixture is not particularly limited, and a typical dew point of the gas mixture is greater than or equal to −60° C. It is to be noted that the dew point of the gas mixture can be adjusted by an amount of moisture contained in the gas mixture.

In the reduction heating zone 2, the iron oxide layer formed in the oxidizing step S31 is reduced before reaching the initial roller (first roller 21*a*) in the reduction heating zone 2. In other words, the reduction of the iron oxide layer is completed before the first roller 21*a* in the reduction heating zone 2. It is to be noted that "completion of the reduction of the iron oxide layer" as referred to herein means that, in plan view, greater than or equal to 90% of the area of the iron oxide layer at the inlet of the reduction heating zone 2*a* has been reduced.

The present inventors have found that, for the reduction of the iron oxide layer and the annealing of iron which follows, a temperature higher than a temperature at which the iron oxide sinters is preferable. For this reason, it is considered that if the steel sheet M reaches the first roller 21*a* with the iron oxide layer left, roll pickup will occur at the first roller 21*a*. Accordingly, the present inventors have carefully investigated inhibition of the roll pickup and discovered that the problem of the roll pickup can be resolved by reducing the iron oxide layer before it reaches the first roller 21*a* in the reduction heating zone 2, thus completing the present invention.

Furthermore, the present inventors have found that as conditions that enable reducing of the iron oxide layer before it reaches the first roller 21*a* in the reduction heating zone 2, it is preferable that the reduction temperature of the iron oxide layer at the first roller 21*a* of the reduction heating zone 2 is greater than or equal to 750° C.; and that the reduction time period during which the reduction temperature of the iron oxide layer is greater than or equal to 700° C. in a segment from the inlet of the reduction heating zone 2*a* to the first roller 21*a* in the reduction heating zone 2 is greater than or equal to 20 sec. In other words, both in a case in which the reduction temperature of the iron oxide layer at the first roller 21*a* of the reduction heating zone 2 is less than 750° C. and in a case in which the reduction time period during which the reduction temperature is greater than or equal to 700° C. is less than 20 seconds, the reduction of the iron oxide layer may be insufficient, and roll pickup may occur at the first roller 21*a*.

A reduction temperature T1 of the iron oxide layer at the inlet of the reduction heating zone 2*a* (hereinafter, may be also referred to as simply "reduction temperature T1") is mainly determined depending on the oxidation temperature T0 of the steel sheet M in the oxidizing step S31. Since the oxidation temperature T0 of the steel sheet M in the oxidizing step S31 is typically set to be less than the reduction temperature of the iron oxide layer, the reduction temperature T1 is preferably set to be less than the reduction temperature T2 of the iron oxide layer at the first roller 21*a* in the reduction heating zone 2 (hereinafter, may be also referred to as simply "reduction temperature T2"). By setting the reduction temperature T1 to be less than the reduction temperature T2, the thermal efficiency can be increased and the production cost can be reduced.

The lower limit of the reduction temperature T1 is preferably 650° C., and more preferably 700° C. Meanwhile, the upper limit of the reduction temperature T1 is preferably 750° C., and more preferably 740° C. When the reduction temperature T1 is below the lower limit, lowering of the feeding speed of the steel sheet M may be needed to ensure the reduction time period during which the reduction temperature is greater than or equal to 700° C., which may lower the production efficiency. Conversely, when the reduction temperature T1 exceeds the upper limit, performing heating may be needed, for example, at the conveying path 3 after the oxidation heating zone 1 has been passed, which may raise the apparatus cost for the annealing furnace.

It is to be noted that, as described above, the present inventors have found that the reduction time period during which the reduction temperature is greater than or equal to 700° C. is preferably greater than or equal to 20 sec. Accordingly, in a case in which the reduction temperature T1 is less than 700° C., it is preferable that the steel sheet M is heated quickly after passing the inlet of the reduction heating zone 2*a*. Although the heating procedure is not particularly limited, an apparatus capable of rapid heating, such as an induction heating apparatus or the like, can be used.

As described above, the reduction temperature T2 is preferably greater than or equal to 750° C. Although the reduction temperature T2 may be adjusted by providing a heating apparatus such as a radiant tube from the inlet of the reduction heating zone 2*a* to the first roller 21*a*, the reduction temperature T2 is preferably controlled by a reducing atmosphere temperature in the reduction heating zone 2.

The reducing atmosphere temperature in the reduction heating zone 2 is not particularly limited as long as the reduction temperature of the steel sheet M can be set to a desired temperature, and the lower limit of the reducing atmosphere temperature in the reduction heating zone 2 is preferably 800° C., and more preferably 850° C. Meanwhile, the upper limit of the reducing atmosphere temperature is preferably 920° C., and more preferably 900° C. When the reducing atmosphere temperature is below the lower limit, it may not be possible to set the reduction temperature T2 to greater than or equal to 750° C. Conversely, when the reducing atmosphere temperature exceeds the upper limit, iron may be oxidized in the annealing of iron, which is performed following the reduction of the iron oxide layer.

It is to be noted that the upper limit of the reduction temperature T2 is preferably 850° C. When the reduction temperature T2 exceeds the upper limit, a cost required for heating rises in relation to an effect of improving a reduction reaction, which may lead to insufficient cost-effectiveness.

The reduction time period during which the reduction temperature is greater than or equal to 700° C. can be adjusted by the feeding speed of the steel sheet M and the distance from the inlet of the reduction heating zone 2*a* to the first roller 21*a*.

The lower limit of a traveling distance of the steel sheet M from the inlet of the reduction heating zone 2*a* to the first roller 21*a* is preferably 10 m, and more preferably 15 m. Meanwhile, the upper limit of the traveling distance to the first roller 21*a* is preferably 30 m, and more preferably 25 m. When the traveling distance to the first roller 21*a* is below the lower limit, the feeding speed of the steel sheet M needs to be lowered to ensure the reduction time period of the iron oxide layer, which may lower the production efficiency, Conversely, when the traveling distance to the first roller 21*a* exceeds the upper limit, an excessively great height of the annealing furnace may raise the apparatus cost.

The upper limit of a traveling time period of the steel sheet M from the inlet of the reduction heating zone 2*a* to the first roller 21*a* is preferably 60 sec. When the traveling time period of the steel sheet M exceeds the upper limit, the reduction time period of the iron oxide layer becomes unduly long, which may lower the production efficiency; and an excessively great height of the annealing furnace may raise the apparatus cost. Moreover, for similar reasons, the upper limit of the reduction time period during which the reduction temperature is greater than or equal to 700° C. is also preferably 60 sec.

It is to be noted that the lower limit of the traveling time period of the steel sheet M from the inlet of the reduction heating zone 2*a* to the first roller 21*a* is preferably 20 sec. By setting the traveling time period to be greater than or equal to the lower limit, the reduction time period during which the reduction temperature is greater than or equal to 700° C. can be greater than or equal to 20 sec.

The reduction time period in the reducing step S32 as a whole is appropriately determined in light of the production efficiency and the like, and can be greater than or equal to 60 sec and less than or equal to 300 sec.

Galvanized Layer-Forming Step

In the galvanized layer-forming step S4, a galvanized layer is formed on the surface of the steel sheet M after the annealing step S3.

A process for forming the galvanized layer is not particularly limited, and a known process can be appropriately used. As the formation process of the galvanized layer, for example, a process in which the steel sheet M after the annealing step S3 is immersed in a coating bath can be exemplified. In the immersion in the coating bath, the mass of coating is preferably controlled to greater than or equal to 20 g/m$^2$ and less than or equal to 200 g/m$^2$ by, for example, gas wiping or the like.

For example, an alloy coating containing greater than or equal to two elements including Zn can be used for the coating bath. The alloy coating containing greater than or equal to two elements including Zn can be exemplified by an Al—Zn coating, a Fe—Zn coating, a Ni—Zn coating, a Cr—Zn coating, a Mg—Zn coating, and the like.

The coating bath can be performed in such a manner that, for example, the steel sheet M is immersed using coating containing components other than zinc at a concentration of, for example, greater than or equal to 0.01% by mass and less than or equal to 0.5% by mass, and an immersion temperature of greater than or equal to 300° C. and less than or equal to 600° C. for greater than or equal to 1 sec and less than or equal to 30 sec.

Alloying Step

In the alloying step S5, an alloying treatment of the steel sheet M is performed after the galvanized layer-forming step S4.

Without particular limitation, the alloying treatment can be performed, using a known process as appropriate, on the steel sheet M after the galvanized layer-forming step S4. As the alloying treatment, for example, a process in which reheating is performed at an alloying temperature of greater than or equal to 470° C. and less than or equal to 600° C. for greater than or equal to 1 sec and less than or equal to 100 sec can be exemplified.

Advantages

Due to employing an oxidation-reduction process, the production method of a hot-dip galvanized steel sheet provides superior coating adhesiveness. In the production method of a hot-dip galvanized steel sheet, roll pickup is prevented by forming the oxide layer in the oxidizing step S31 at a temperature at which roll pickup does not occur, i.e. a temperature at which oxides of iron are less likely to sinter with each other. Furthermore, in the production method of a hot-dip galvanized steel sheet, the iron oxide layer is reduced in the reducing step S32 before reaching the initial roller; therefore, the iron oxide, which causes roll pickup, is removed from the steel sheet M before it reaches the initial roller in the reduction heating zone 2. Hence, the use of the production method of a hot-dip galvanized steel sheet enables prevention of roll pickup while maintaining superior coating adhesiveness.

Other Embodiments

It is to be noted that the production method of a hot-dip galvanized steel sheet of the present invention is not limited to the above embodiment.

In the above embodiment, a case in which direct-fired burners are used as the heating device in the oxidation heating zone in the oxidizing step has been described; however, the heating device is not limited thereto as long as the iron oxide layer is obtained. For example, indirect heating by means of an oxidizing atmosphere containing oxygen, moisture, and/or the like may be used as the heating device.

In the above embodiment, a case in which the production method of a hot-dip galvanized steel sheet includes the alloying treatment has been described; however, the alloying treatment is not an essential component and can be omitted.

Furthermore, in the above embodiment, a case in which the base steel sheet is obtained through the hot rolling step and the cold rolling step has been described; however, the process for obtaining a base steel sheet is not limited thereto, and for example, a steel sheet produced in advance may be used.

In the above embodiment, a case in which the annealing furnace is a vertical furnace has been described; however, a horizontal furnace can also be used in the production method of a hot-dip galvanized steel sheet.

In the above embodiment, a case in which the annealing furnace has the conveying path which connects the oxidation heating zone to the reduction heating zone has been described; however, the conveying path is not an essential component, and the oxidation heating zone may be directly connected to the reduction heating zone.

EXAMPLES

Hereinafter, the present invention will be described further in detail by way of Examples; however, the present invention is not limited to these Examples.

Confirmation of Composition of Iron Oxide Layer

A composition of the iron oxide layer formed in the oxidizing was confirmed.

Fabrication of Samples

A cast piece obtained by melting steel containing chemical components other than iron shown in Table 1 was processed by a hot rolling and a cold rolling to obtain a base steel sheet with an average thickness of 1.8 mm. It is to be noted that the pickling conditions in the cold rolling were adjusted such that a grain boundary oxide layer with an average thickness of 10 μm was left.

TABLE 1

| Element | | | | | |
|---|---|---|---|---|---|
| C (% by mass) | Si (% by mass) | Mn (% by mass) | Al (% by mass) | P (% by mass) | S (% by mass) |
| 0.185 | 2.02 | 2.62 | 0.04 | 0.010 | 0.001 |

An oxidizing using an annealing furnace with the direct-fired burners 12 illustrated in FIG. 3 was performed on the base steel sheet at oxidation temperatures T0 (temperatures at the outlet of the oxidation heating zone 2*b*) shown in Table 2 to obtain Samples No. 1 to No. 4. It is to be noted that in oxidation conditions, LNG was used as a combustion gas of the direct-fired burners 12; the air ratio was 1.1; and the rate of temperature rise was 37° C./sec. It is to be noted that to prevent further oxidation, cooling to a normal temperature was performed immediately after the oxidizing while a nitrogen gas was blown.

Evaluations

Phase compositions of the oxide layers on the steel sheet surfaces of the Samples No. 1 to No. 4 thus obtained were analyzed by an X-ray diffraction method. The results are as indicated in Table 2.

TABLE 2

| | Oxidation | Composition | | | |
|---|---|---|---|---|---|
| | temperature T0 (° C.) | $Fe_2O_3$ (% by mass) | $Fe_3O_4$ (% by mass) | FeO (% by mass) | (Fe—Mn)O (% by mass) |
| No. 1 | 600 | 0.0 | 100.0 | 0.0 | 0.0 |
| No. 2 | 650 | 0.0 | 100.0 | 0.0 | 0.0 |
| No. 3 | 700 | 0.0 | 68.9 | 14.4 | 16.7 |
| No. 4 | 750 | 0.0 | 68.9 | 17.8 | 13.3 |

The results in Table 2 indicate that the main component of the iron oxide layers was $Fe_3O_4$, although FeO and (Fe—Mn)O were also generated by oxidation at high temperatures of greater than or equal to 700° C.

Confirmation of Conditions for Occurrence of Roll Pickup in Oxidizing

The present inventors consider that as a mechanism of roll pickup occurrence: oxides being powdery in form, which are generated on the surface of the steel sheet, initially attach to the surface of a roller; the oxides (attached substances) thus attached then grow by coming in contact and sintering with each other; and then the attached substances, having grown, cause a pressing mark on the steel sheet. Accordingly, a test was carried out in which a $Fe_3O_4$ powder (iron oxide (II, III), manufactured by Kojundo Chemical Lab. Co., Ltd.; purity: 98%; grain diameter: less than or equal to 1 μm) was brought into mutual contact with a surface of a roller (a roller provided with a spray coating film, manufactured by TOCALO Co., Ltd.; $ZrO_2$-based; film thickness: 100 to 300 μm; surface roughness Ra=3 μm) of the annealing furnace.

In test conditions, the furnace atmosphere was a nitrogen atmosphere (dew point: less than −40° C.; oxygen concentration: less than 10 ppm), and the contact pressure between the $Fe_3O_4$ powder and the roller was 5.76 kg/cm$^2$. Further, the contact between the $Fe_3O_4$ powder and the roller was carried out such that 2 seconds of contact and 2 seconds of non-contact were repeated in this order for 5 hrs. The contact pressure described above is 20 times the contact pressure in actual oxidizing. This test is an accelerated test. It is to be noted that the contact pressure has been revealed not to influence the temperature at which roll pickup occurs.

Under the conditions described above, whether roll pickup had occurred was confirmed at eight furnace temperatures of A, B, C, D, E, F, G, and H, shown in Table 3. The roller was visually observed to confirm whether roll pickup had occurred; when an attached substance that would cause a pressing mark on the steel sheet was recognized, it was judged that roll pickup had occurred. The results are as indicated in Table 3.

TABLE 3

| | Test temperature (° C.) | Occurrence of roller-pickup |
|---|---|---|
| A | 600 | No |
| B | 650 | No |
| C | 700 | No |
| D | 710 | No |
| E | 720 | No |
| F | 730 | No |

TABLE 3-continued

| | Test temperature (° C.) | Occurrence of roller-pickup |
|---|---|---|
| G | 740 | No |
| H | 750 | Yes |

As shown in Table 3, the occurrence of roll pickup, which is considered to be caused by sintering of the attached substances, was able to be reproduced at a test temperature of 750° C., as assumed by the present inventors. Based on this, it is considered that the occurrence of roll pickup can be inhibited by setting the oxidation temperature to less than or equal to 740° C.

Confirmation of Occurrence of Roll Pickup in Annealing

As the annealing, the oxidizing was performed under the condition for No. 1 in Table 2 (oxidation temperature T0=600° C., a temperature at which roll pickup does not occur), and then the reducing was continuously performed for 5 hours under conditions shown in Table 4 for Examples 1 to 7 and Comparative Examples 1 to 5. It is to be noted that a gas Mixture of hydrogen and nitrogen having a hydrogen concentration of 5% by volume and a dew point of −20° C. was used as a reducing atmosphere. Further, the reducing was carried out until the iron oxide layer had reached the initial roller (first roller) in the reduction heating zone, and rapid cooling to a normal temperature was performed.

Evaluations

Regarding the steel sheets of Examples 1 to 7 and Comparative Examples 1 to 5 after the reducing, percentages of iron (reduced iron) and $Fe_XO_Y$ (unreduced iron) in surface layers of the steel sheets were calculated by an Auger electron spectroscopy analysis. To eliminate surface contamination, a face obtained by removing the surface layer by sputtering to a depth at which no C component was detected was defined as the outermost surface. The analysis was conducted to a depth of 3 nm from the outermost surface. For analysis results, Fe peaks were subjected to waveform separation and quantified. Based on obtained values, the reduction was judged to be "complete" in a case in which the percentage of reduced iron in the surface layer of the steel sheet was greater than or equal to 90%; and the reduction was judged to be "incomplete" in a case in which the percentage was less than 90%. The results are shown in the column "Judgement of reduction completion" in Table 4.

Furthermore, whether roll pickup had occurred after the reducing at the first roller in Examples 1 to 7 and Comparative Examples 1 to 5 was confirmed. The confirmation method is similar to the confirmation method of the occurrence of roll pickup in the oxidizing. The results are shown in the column "Occurrence of roll pickup" in Table 4.

TABLE 4

| | Inlet temperature T1 (° C.) | 1st roller temperature T2 (° C.) | Traveling time period to 1st roller (sec) | Reduction time period (≥700° C.) (sec) | Judgement of reduction completion | Occurrence of roll pickup |
|---|---|---|---|---|---|---|
| Example 1 | 650 | 750 | 40 | 20 | Complete | No |
| Example 2 | 700 | 750 | 20 | 20 | Complete | No |
| Example 3 | 700 | 750 | 30 | 30 | Complete | No |
| Example 4 | 700 | 750 | 40 | 40 | Complete | No |
| Example 5 | 700 | 800 | 20 | 20 | Complete | No |
| Example 6 | 700 | 800 | 30 | 30 | Complete | No |
| Example 7 | 750 | 850 | 30 | 30 | Complete | No |
| Comparative Example 1 | 650 | 700 | 20 | 0 | Incomplete | Yes |
| Comparative Example 2 | 650 | 700 | 30 | 0 | Incomplete | Yes |
| Comparative Example 3 | 650 | 700 | 40 | 0 | Incomplete | Yes |
| Comparative Example 4 | 650 | 750 | 20 | 10 | Incomplete | Yes |
| Comparative Example 5 | 650 | 750 | 30 | 15 | Incomplete | Yes |

In Table 4, "inlet temperature T1" denotes the reduction temperature of the iron oxide layer at the inlet of the reduction heating zone, and "first roller temperature T2" denotes the reduction temperature of the iron oxide layer at the first roller of the reduction heating zone. "Traveling time period to the first roller" denotes the traveling time period of the steel sheet from the inlet of the reduction heating zone to the first roller, and "reduction time period (≥700° C.)" denotes the time period of the traveling time period during which the reduction temperature of the iron oxide layer was greater than or equal to 700° C.

The results in Table 4 show that roll pickup did not occur in Examples 1 to 7, wherein the iron oxide layers formed in the oxidizing were reduced before the initial roller (first roller) in the reduction heating zone, while roll pickup did occur in Comparative Examples 1 to 5, wherein the iron oxide layers were not completely reduced before the first roller. Accordingly, it can be concluded that the occurrence of roll pickup can be inhibited by reducing the iron oxide layer in the reduction heating zone before it reaches the initial roller in the reduction heating zone.

In more detail, roll pickup did not occur in Examples 1 to 7, in which the reduction temperature of the iron oxide layers at the initial roller in the reduction heating zone was greater than or equal to 750° C. and the reduction time period during which the reduction temperature of the iron oxide layers in the segment from the inlet of the reduction heating zone to the initial roller in the reduction heating zone was greater than or equal to 700° C. was greater than or equal to 20 sec. Moreover, the iron oxide layers of Examples 1 to 7 were able to be reduced with certainty before the initial roller in the reduction heating zone Hence, it can be concluded that roll pickup in the reduction heating zone can be more certainly prevented by setting the reduction temperature of the iron oxide layer to be greater than or equal to the lower limit and setting the reduction time period to be greater than or equal to the lower limit.

As described in the foregoing, the use of the production method of a hot-dip galvanized steel sheet of the present invention enables prevention of roll pickup even in a vertical furnace while maintaining superior coating adhesiveness.

EXPLANATION OF THE REFERENCE SYMBOLS

1: oxidation healing zone
1*a*: inlet of oxidation heating zone
1*b*: outlet of oxidation heating zone
11: roller
12: direct-fired burner
2: reduction heating zone
2*a*: inlet of reduction heating zone
2*b*: outlet of reduction heating zone
21: roller
21*a*: first roller
3: conveying path
31: roller
M: steel sheet

The invention claimed is:

1. A production method of a hot-dip galvanized steel sheet comprising:

annealing a belt-shaped steel sheet having a Si content of greater than or equal to 0.2% by mass, wherein the annealing is carried out continuously using an annealing furnace comprising an oxidation heating zone;

a conveying path under a nitrogen atmosphere, and a reduction heating zone, in this order, while the steel sheet is fed using rollers provided in each of the oxidation heating zone, the conveying path, and the reduction heating zone, and the annealing comprises:

oxidizing a surface of the steel sheet in the oxidation heating zone at a temperature at which roll pickup, resulting from contact between the surface of the steel sheet and the rollers in the oxidation heating zone does not occur, and reducing an iron oxide layer, formed by the oxidizing, in the reduction heating zone before the iron oxide layer reaches an initial roller in the reduction heating zone, wherein an average thickness of the iron oxide layer formed in the oxidizing is greater than or equal to 0.1 μm and less than or equal to 1.5 μm and in the reduction heating zone, a reducing atmosphere temperature is greater than or equal to 800° C. and less than or equal to 920° C., and a distance from an inlet of the reduction heating zone to the initial roller is greater than or equal to 10 m.

2. The production method according to claim 1, wherein an oxidation temperature of the steel sheet in the oxidizing is less than or equal to 740° C.

3. The production method according to claim 1, wherein in the reducing, a reduction temperature of the iron oxide layer at the initial roller in the reduction heating zone is greater than or equal to 750° C., and in a segment from an inlet of the reduction heating zone to the initial roller in the reduction heating zone, a reduction time period during which the reduction temperature of the iron oxide layer is greater than or equal to 700° C. is greater than or equal to 20 sec.

4. The production method according to claim 2, wherein in the reducing, a reduction temperature of the iron oxide layer at the initial roller in the reduction heating zone is greater than or equal to 750° C., and in a segment from an inlet of the reduction heating zone to the initial roller in the reduction heating zone, a reduction time period during which the reduction temperature of the iron oxide layer is greater than or equal to 700° C. is greater than or equal to 20 sec.

5. The production method according to claim 1, wherein a direct-fired burner is used as a heating device for the oxidation heating zone.

6. The production method according to claim 2, wherein a direct-fired burner is used as a heating device for the oxidation heating zone.

7. The production method according to claim 3, wherein a direct-fired burner is used as a heating device for the oxidation heating zone.

8. The production method according to claim 4, wherein a direct-fired burner is used as a heating device for the oxidation heating zone.

* * * * *